US008704839B2

(12) United States Patent
Kobayashi

(10) Patent No.: US 8,704,839 B2
(45) Date of Patent: Apr. 22, 2014

(54) VIDEO FRAME SELF-REFRESH IN A SINK DEVICE

(75) Inventor: Osamu Kobayashi, Los Altos, CA (US)

(73) Assignee: STMicroelectronics, Inc., Coppell, TX (US)

( * ) Notice: Subject to any disclaimer, the term of this patent is extended or adjusted under 35 U.S.C. 154(b) by 441 days.

(21) Appl. No.: 13/114,971

(22) Filed: May 24, 2011

(65) Prior Publication Data

US 2011/0292059 A1 Dec. 1, 2011

Related U.S. Application Data

(60) Provisional application No. 61/348,670, filed on May 26, 2010, provisional application No. 61/348,882, filed on May 27, 2010.

(51) Int. Cl.
*G09G 5/36* (2006.01)
*G09G 5/39* (2006.01)

(52) U.S. Cl.
USPC ..... 345/545; 345/531

(58) Field of Classification Search
USPC ..... 345/545, 530, 531
See application file for complete search history.

(56) References Cited

U.S. PATENT DOCUMENTS

2006/0039468 A1 * 2/2006 Emerson et al. ..... 375/240.01
2011/0078536 A1 3/2011 Han et al.

OTHER PUBLICATIONS

Office Action in Chinese Application No. 201110187648.0 dated Jun. 5, 2013.

* cited by examiner

*Primary Examiner* — Jacinta M Crawford
(74) *Attorney, Agent, or Firm* — Beyer Law Group LLP

(57) ABSTRACT

A sink device having a display panel capable of performing a video frame self-refresh as directed by a source device is described. A source determines that a video frame will persist (i.e., remain the same). In this situation, the frame data does not need to be repeatedly transmitted over a main link between the source and sink devices. The main link can be turned off and transmission can cease for a certain time thereby reducing power usage by the devices or system as a whole. The source ensures that the last frame transmitted to the sink is correct by performing CRC checks and then instructs the sink, via certain bit settings in a video status indication symbol, to store the last transmitted frame in the sink's local buffer and use that frame to refresh the panel. The source can then disable the self-refresh when the frame changes.

26 Claims, 9 Drawing Sheets

VIDEO FRAME SELF-REFRESH IN A SINK DEVICE

CROSS-REFERENCE TO RELATED APPLICATIONS

This application claims priority under 35 U.S.C. §119(e) to Provisional Patent Application No. 61/348,670, filed May 26, 2010, entitled "ENABLING SELF REFRESHING OF A DISPLAY SCREEN BY A DISPLAY CONTROLLER WHILE THE SOURCE DEVICE IS POWERED" and Provisional Patent Application No. 61/348,882, filed May 27, 2010, entitled "ENABLING SELF REFRESHING OF A DISPLAY SCREEN BY A DISPLAY CONTROLLER WHILE THE SOURCE DEVICE IS POWERED", each of which is incorporated by reference herein in their entireties.

TECHNICAL FIELD

The present invention relates generally to reducing power consumption in display components video source devices. More specifically, it relates to enabling a sink device to perform a self-refresh of a display panel with video frame data as directed by a source.

BACKGROUND OF THE INVENTION

Reducing power consumption is becoming increasingly important and desirable. There is a growing awareness that consumer electronics, including computers, consume power, many times unnecessarily. This has led to a strong trend to reduce electrical usage in consumer electronic devices, including power consumption in computers and monitors. In display devices in particular, such as LCD, LED, and plasma monitors, power consumption can be reduced by addressing the area of video screen refresh. Power is used when a video frame is refreshed, or transmitted, from a source device, such as a computer, to a sink device, such as a monitor. Video refresh is generally needed to prevent fading of an image of a video frame. Video frame refreshing between a source and sink is often done continuously. Video data is constantly sent from the source to the sink. However, when a video frame is static, there is no need for a graphics controller in the source device to constantly transmit video data to a display controller in a sink device over a main link, which, clearly, must be powered on in order to be used for the transmission.

It would be desirable to be able to reduce the number of video frame transmissions over the main link (display interface) from the source device to the sink. This would allow the main link to be turned off for certain time periods. It would also be desirable to be able to turn off the power of the graphics controller when not needed.

SUMMARY OF THE INVENTION

In one aspect of the invention, methods of enabling a sink device to perform self-refreshing of a video data frame are described. The sink device is connected to a source device via a main link and an auxiliary channel. The video frame data is transmitted over the main link from the source to the sink. However, if the source determines that the video frame will not change, i.e., will persist, it can instruct the sink device to store the frame in its local buffer and use the frame to perform self-refresh of the frame on a display panel in the sink device.

The source device determines that the video frame will persist. It can do this by examining graphics rendering commands and whether such commands are executed. The source sets a particular bit of a primary video status indicator symbol to 1. For example, bit 6 of a VB-ID packet in a packet-based digital display interface standard (e.g., DisplayPort). The source may then calculate a frame CRC (source-derived CRC) of the current video data frame. It also receives a sink-derived CRC for the frame from the sink device (RD_CRC). A comparison is then made of the two CRC values to determine if they are equal. If they are, the video frame was stored correctly and cleanly in the sink device (remote) frame buffer and can be used for self-refresh. The video frame that was being transmitted when the source determined that self-refresh is appropriate is transmitted and the following frame is also transmitted. It is this subsequent frame that is stored in remote buffer. The source may then terminate or turn off the main link between the source and sink and cease transmission of video data to reduce power usage. The sink device then uses the stored video frame to refresh its panel.

In another embodiment, a source device that instructs a sink device to enter self-refresh mode based on the persistence of video frame data is described. A source device has a local (source) frame buffer for storing video frame data. This buffer is in communication with a graphics controller. The graphics controller has a transmitter for sourcing the video data over a main link. It may also have a CRC value comparison logic module for comparing CRC values. It may also derive the CRC value (a frame CRC) for the source which is compared to a CRC value received from the sink device. It may also have a frame persistence module which has firmware for determining whether a frame will be the same. It may also have a primary video status indication symbol modification module or firmware for changing bits in a status indication symbol, such as a VB-ID packet where bits 6 and 3 may be used in communicating whether self-refresh mode should be enabled. Also in the source device may be a network interface for interfacing with the main link and an auxiliary channel connected to the sink device.

Another aspect of the invention is a graphics controller having a transmitter for sourcing video frame data to another device, such as a sink device. It may also have a network interface for interfacing with one or more data communication channels. It may also have a CRC checking module for performing CRC checks. It may also have firmware for a video frame persistence module for determining whether a video frame will persist. It may also have firmware for a primary video status indication symbol modification module for changing bits in a status indication symbol.

General aspects of the invention include, but are not limited to methods, systems, apparatus, and computer-readable media for enabling message transmission in multimedia device networks.

BRIEF DESCRIPTION OF THE DRAWINGS

The invention and the advantages thereof may best be understood by reference to the following description taken in conjunction with the accompanying drawings in which.

In the drawings, like reference numerals are sometimes used to designate like structural elements. It should also be appreciated that the depictions in the figures are diagrammatic and not to scale.

DETAILED DESCRIPTION

Reference is made to particular embodiments of the invention. One example of which is illustrated in the accompanying drawings. While the invention will be described in conjunction with the particular embodiment, it will be understood that it is not intended to limit the invention to the described embodiment. To the contrary, it is intended to cover alternatives, modifications, and equivalents as may be included within the spirit and scope of the invention as defined by the appended claims.

Figure 1:
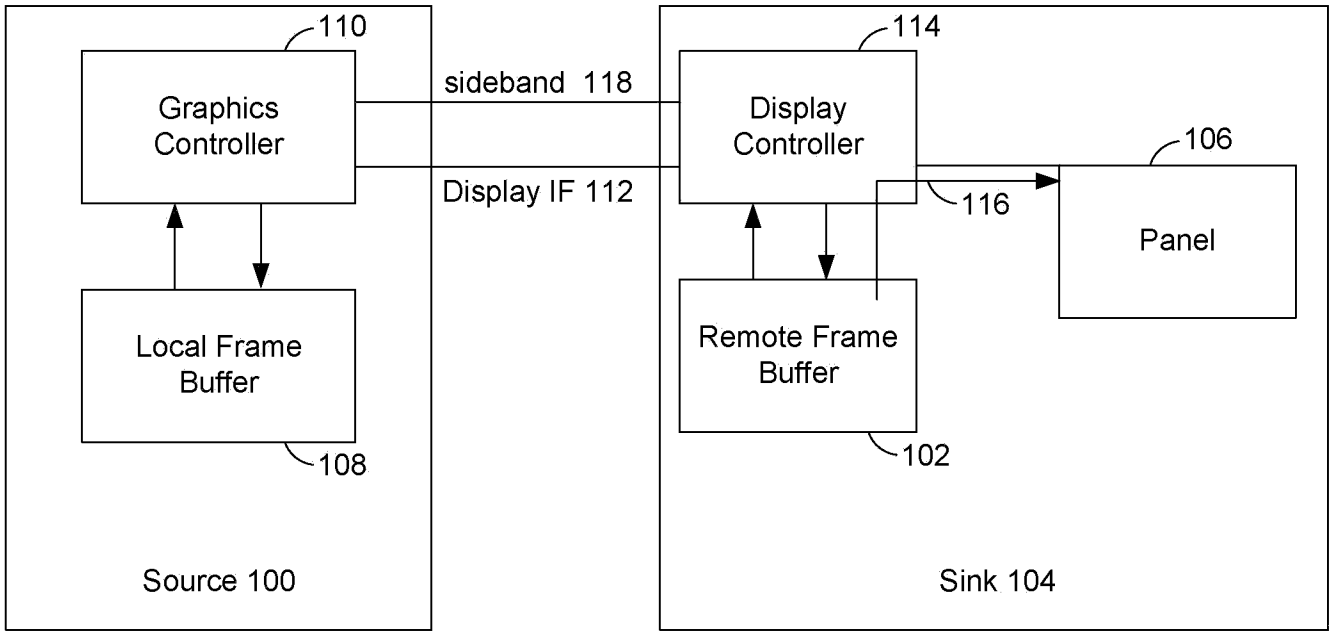
FIG. 1 is a block diagram showing a source device and a sink device and communication channels between them.

Methods and systems for video frame self-refresh in a sink device having a display panel in the context of a packet-based digital interface standard are described in the various figures. FIG. 1 is a block diagram showing a source device 100, such as a computer, and a sink device 104, such as a computer monitor (also referred to as a display device). In one embodiment, there are two communication links connecting source 100 and sink 104: a display interface 112, also referred to as a main link, and an auxiliary or sideband communication link 118. As described below, each is used for transmitting certain types of data between the two devices. The two devices may be housed in one box, such as a TV or a laptop computer, or they may be two physically separate boxes or components, such as a desktop computer and a separate monitor.

Source 100 has two internal components that are relevant to the present invention. One is a local frame buffer (LFB) or memory 108. This contains the video data that is ultimately displayed on sink 104, specifically, a panel in sink 104. It is referred to as "local" because the primary operations and logic for implementing the invention occurs on source 100. Therefore, it is seen as the home or local device. The operations take place from the perspective of source 100. Also on source 100 is a graphics controller 110. As is known in the art, controller 110 sources the video stream to sink 104 over main link 112 using a transmitter (not shown). Graphics controller 110 has knowledge or intelligence relating to the video stream and knows when to perform a refresh or when a refresh may not be needed, as described below. It reads and writes video stream data to and from LFB 108. Graphics controller 110 is further described in FIG. 8.

Sink device 104 has a display controller 114 which writes the video frame data received from source 100 to a remote frame buffer (RFB) or memory 102 ("remote" because sink 102 is seen as the receiving device from the perspective of source 100) and reads RFB 102 for rendering video on a panel 106. Video frame data is displayed on panel 106 (utilizing, for example, LCD, LED, or other type of display technology). The self-refresh operations, performed by sink 104, but instructed to do so by source 100, are shown by a line 116 from RFB 102 to panel 106.

When self-refresh is enabled, remote frame buffer 102 in sink device 104 refreshes panel 106 repeatedly, instead of the video frame data being sourced from source 100 (local frame buffer 108, through graphics controller 110) over main link 112. Sourcing the video frame data from local frame buffer 108 over main link 112 consumes power and, as described below, may not always be necessary. With the self-refresh mode of the present invention, graphics controller 110 may not need to be powered on and constantly transmitting video data over display interface 112 to display controller 114 in sink 104. More specifically, a write to local frame buffer 108 by graphics controller 110 and a read from local frame buffer 108 to controller 110 may both be eliminated. Video frame data transmission over main link 112 is also eliminated. Instead, a refresh from RFB 102 to panel 106 is performed as shown by line 116. Once an active video frame is stored in RFB 102, it can refresh panel 106. This process is described in more detail in the figures below.

Figure 2:
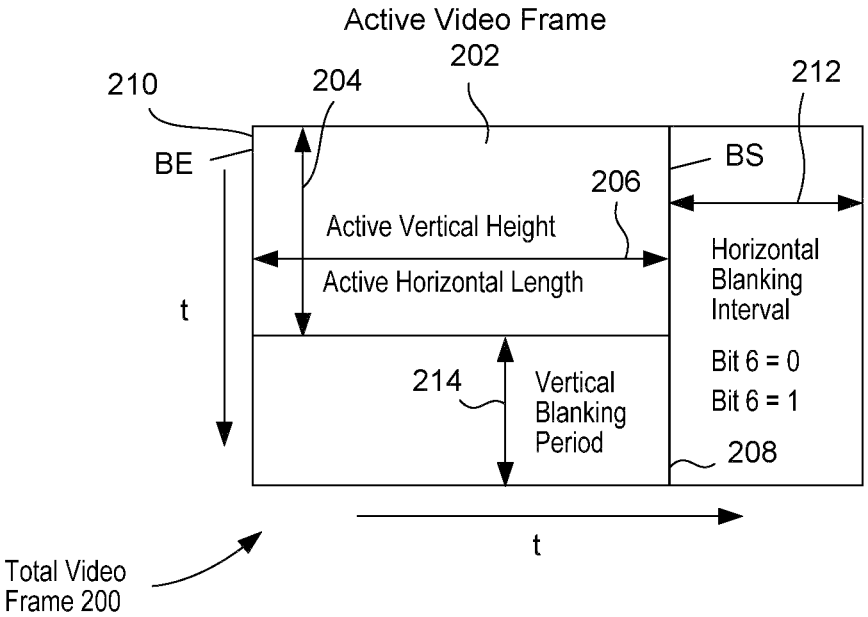
FIG. 2 is a two-dimensional time diagram showing the transmission of an active video frame over a main link.

FIG. 2 is a two-dimensional time diagram showing the transmission of an active video frame over a main link in accordance with one embodiment. Time progresses from left to right and from top to bottom. The time diagram 200 reflects the time it takes and the various intervals or periods involved in sending an active video frame from a source to a sink device. The time in which an active frame N is transmitted over the main link from a source to a sink is shown in area 202, labeled as active video frame 202. An active vertical height or period is shown by arrow 204 (which is representative of a specific length of time) and the active horizontal length or period is shown by arrow 206. The remaining area in time diagram 200 comprises a blanking period where active video is not sent (an idle pattern is present). A blanking period starts ("BS") at line 208, which is comprised of the right edge of active video frame 202 plus the extension beyond active vertical period 204 (i.e., through vertical blanking period 214), and continues until the end of total video frame 200. The blanking period ends ("BE") on the left edge 210 of active video frame 202 (that is, left edge 210 that represents the BE line does not extend to the portion below active vertical period 204 in contrast to line 208 which does extend with respect to the BS line). Arrow 212 represents a horizontal blanking interval and arrow 214 shows a vertical blanking interval. During the active video frame period, the source device and the sink are both updating the CRC of the video data. This CRC value is used in the self-refresh process as explained below.

During the time that active video frame 202 is being transmitted (period 206 and period 204), bit 6 of a primary video status indication symbol, referred to as VB-ID in the packet-based digital display standard, noted above, is set to 0 and bit 3 of the status indication symbol is set to 0. In a packet-based display interface, VB-ID indicates whether the video is being transmitted, and if so, whether the video is in a vertical blanking interval or not. This may dictate certain conditions, for example, such as whether audio should be muted. Bit 6 may be used as a "SaveNextActiveFrame_Flag" and Bit 3 may be used as a "NoVideoStream_Flag." In the display interface standard, VB-ID is comprised of 8 bits. In other embodiments or interface standards, it may be comprised of more or fewer than 8 bits. In one embodiment, the VB-ID packet or symbol is sent four times from source to sink to ensure error reduction. As noted, in one embodiment, bit 6 of the VB-ID is used to indicate self-refresh. If bit 6 is set to 1 by the source device, the source is enabling self-refresh and the sink device will follow this instruction, as explained in FIG. 3. The source may send a VB-ID packet with Bit 6 set to 1 at least three times before the start of the next active frame (active video frame N+1) will be stored in RFB 102. Bit 6 is cleared (set from 1 to 0) after a successful CRC check during the vertical blanking interval before active video frame N+2 which would be normally transmitted. In one embodiment, Bit 3 is set to 1 (indicating that no video stream is coming) for 8 lines before the source turns off main link 112. These processes are explained in further detail below.

Figure 3A:
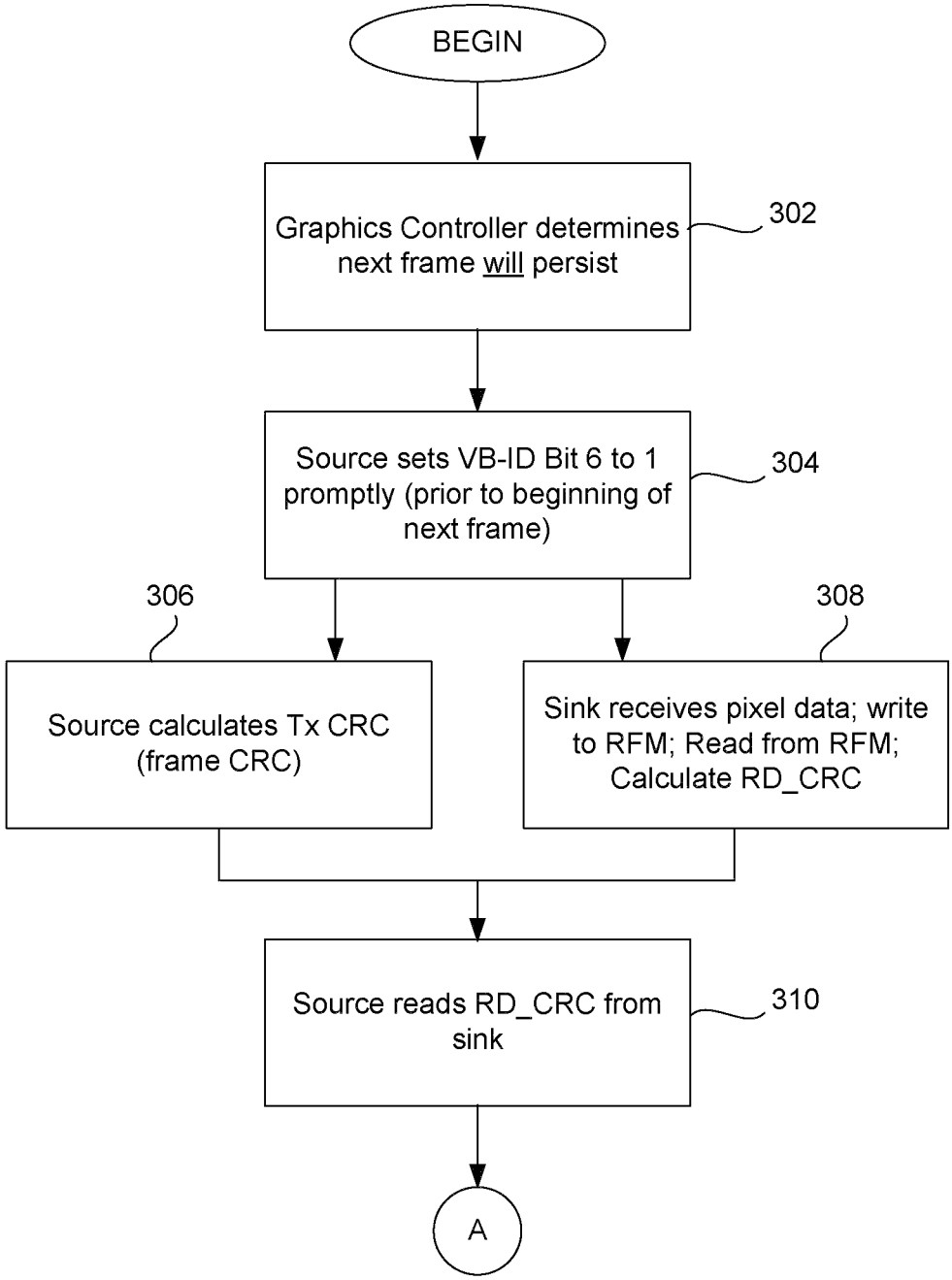
FIGS. 3A and 3B are a flow diagram of a self-refresh process that occurs in the sink device as directed by a source.
Figure 3B:
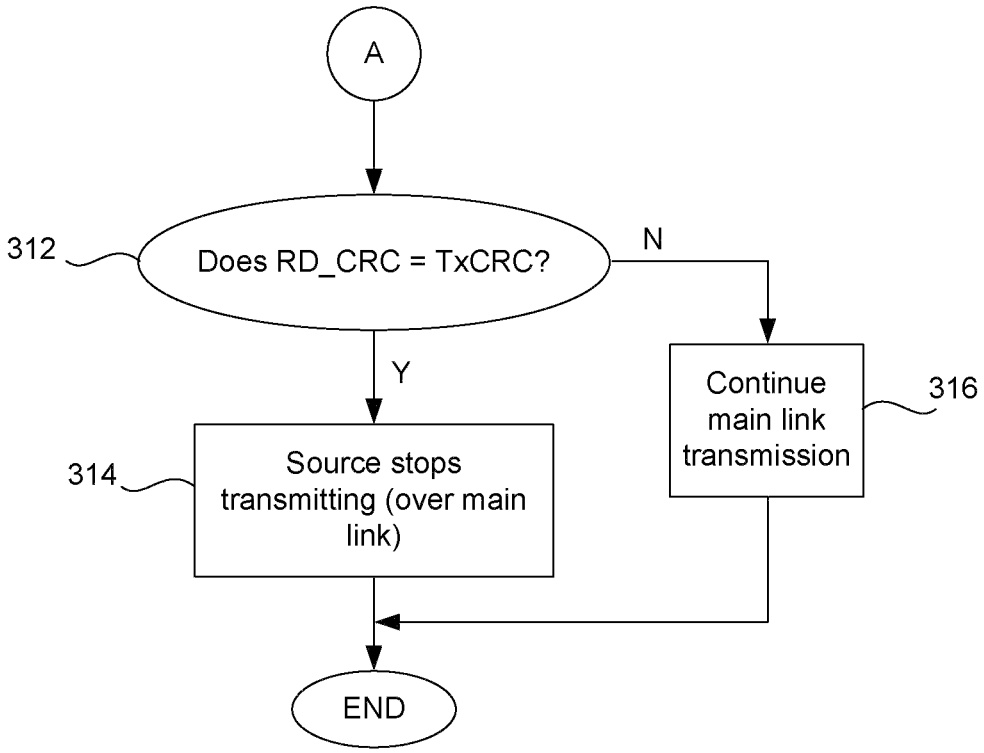

FIGS. 3A and 3B are a flow diagram of a self-refresh process that occurs in the sink device as directed by a source in accordance in one embodiment. At step 302 the graphics controller determines that the next video frame will be the same moving forward; that is, it will persist. This may be determined by the source by examining whether graphics rendering commands for changing the content of the graphics are being executed or not. At step 304 the source sets VB-ID or primary video status indication symbol bit 6 to 1 immediately after it has determined that the video frame is not changing. When a frame does not change (i.e., will persist) and the source is aware of this, the source has the intelligence to direct the sink to perform self-refreshes of that video frame. In this manner, the source or the component housing the source and sink is able to reduce power consumption. This is done prior to the beginning of the next video frame. After step 304, steps 306 and 308 occur.

At step 306 the source calculates the transmitter CRC (or frame CRC). This may be done using techniques known in the art. At step 308 the sink receives the video frame data and writes it to the RFB. This may be done at generally the same time as the CRC calculation by the transmitter. The video frame is read from the RFB to the panel. At the same time, the sink device calculates a CRC of the video frame data (remote device or RD_CRC).

At step 310 the sink device transmits the RD_CRC to the source over the sideband channel. At step 312 graphics controller compares the RD_CRC and the TX_CRC values. Specifically, the graphics controller determines whether the two values are equal. If they are, control goes to step 314 at which time the source stops transmitting video data frames over the main link to the sink. Bit 3 of the status indication symbol is set to 1. If they are not equal, control goes to step 316 where the source continues normal transmission of video frame data to the sink (continue "source refresh" mode). After steps 314 and 316, the self-refresh determination process is complete.

Figure 4:
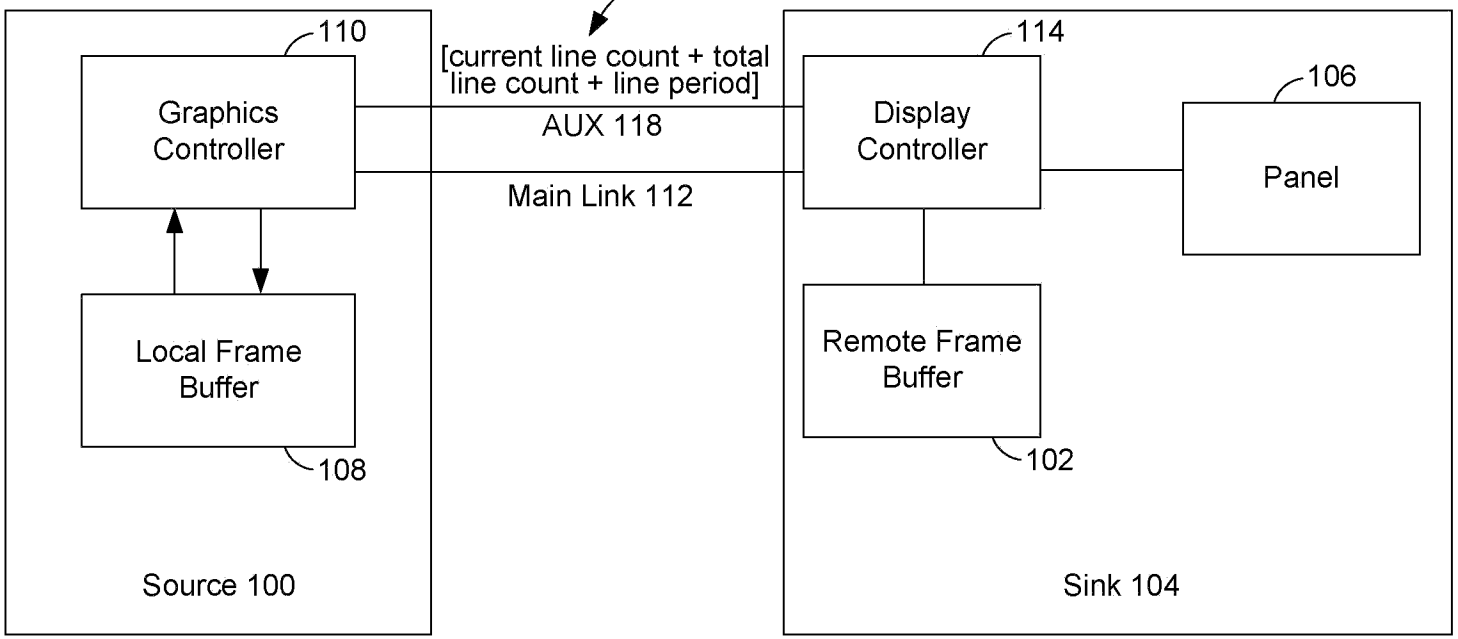
FIG. 4 is a block diagram of source and sink devices showing self-refresh disable.

FIG. 4 is a block diagram of source and sink devices showing self-refresh disable in accordance with one embodiment of the present invention. On the left is source device 100 and on the right is sink device 104, each having the same components as shown in FIG. 1. In one embodiment, determining whether to disable self-refresh, which implies enabling main link 112, is made by source 100, specifically graphics controller 110. Controller 110 makes this determination to resume to normal mode and then reads certain data from display controller 114 in sink 104 over auxiliary channel 118. In one embodiment, this data consists of a current line count, a total line count, and a line period (e.g., in μs), relating to a displayed video frame.

In one embodiment, current line count, referred to above, is comprised of 16 bits. The sink replies with the current line count at the time it starts sending a reply data field (following a 4-bit command and 20-bit address). The total line count may also be comprised of 16 bits. This is the active video line total of the self-refreshed video frame. The line period may be comprised of 8 bits and represents the self-refreshed video frame line period in microseconds. The fields may be placed consecutively when transmitted to the source so that the graphics controller 110 can read them in a single native auxiliary burst read.

Graphics controller 110 enables the main link and begins sending video frame data upon examining the current line count, total line count, and line period. If the source knows that the next frame will be different (will not persist), it will go to source or normal refresh. It sets the primary video status indication symbol, VB-ID, bit 6 from 1 back to 0 to disable self-refresh. In one embodiment, the source may adjust the timing of resuming the video frame transmission to coincide with the vertical blanking interval of the sink's self-refreshed video frame. This helps the sink minimize frame switching synchronization from self-refreshed video frame to received video frame.

As noted, the source device is able to determine when entering self-refresh mode is appropriate because it is aware of when the video frame is static. The source device also has suitable methods of checking to ensure that the last video frame sent to the sink device was properly transmitted and stored in the remote frame buffer using CRC checks, as described below. In another embodiment, the sink device may determine to go into self-refresh mode on its own, that is, without any input or instructions from the source device. In this embodiment, if the sink detects that the source device is not sending any active video frames, it may enter self-refresh mode. The source may stop sending video data for an unknown reason, in which case the sink may automatically read the last forwarded frame (previous frame) stored in its buffer to refresh the panel or screen. The sink may make this decision if the source does not send active frame data for a certain threshold of time. In this embodiment, the source is not making the decision to enter self-refresh mode, but rather, because of its failure to transmit active data, forces the sink device to enter self-refresh mode.

Figure 5:
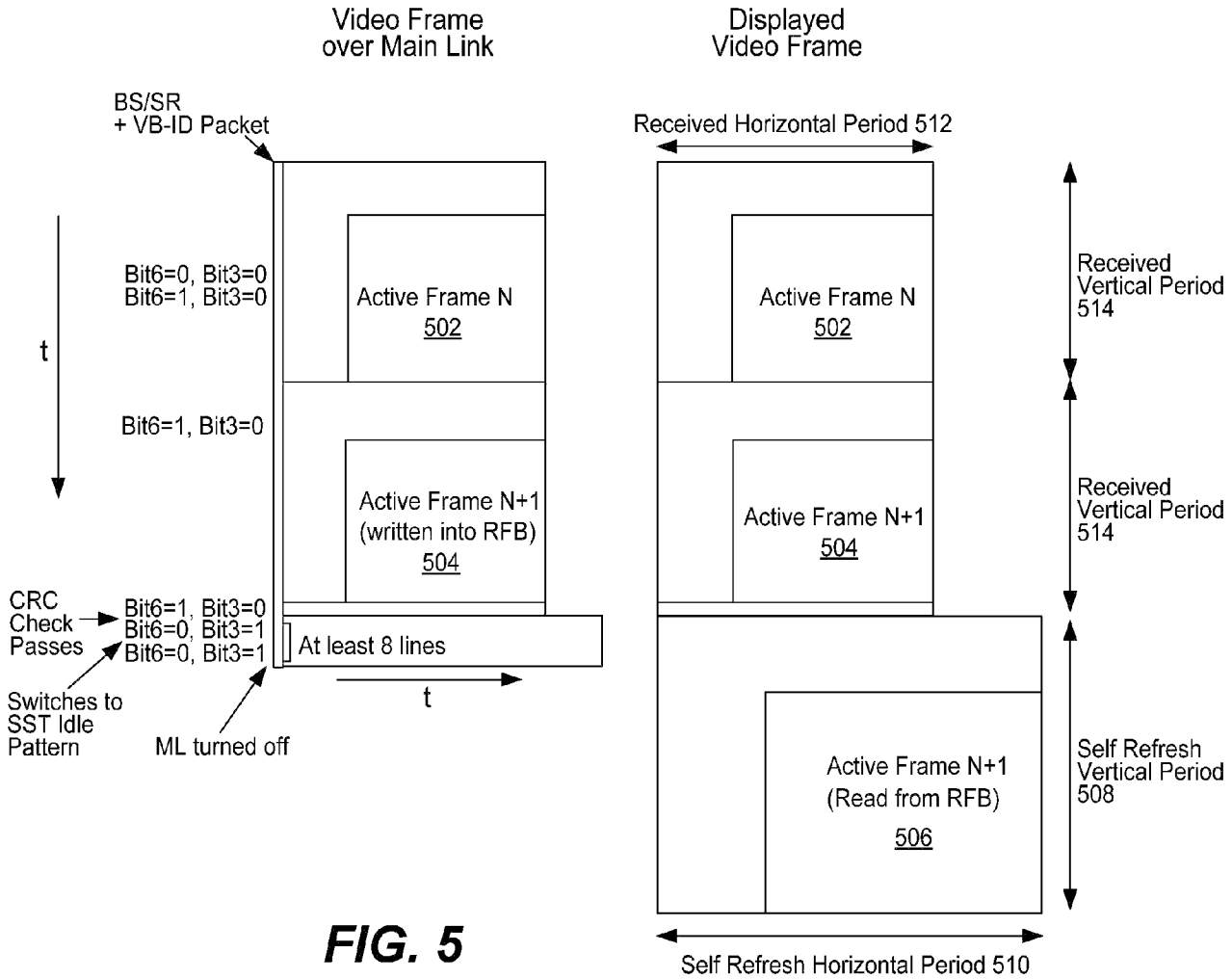
FIG. 5 shows two two-dimensional time diagrams similar to the ones shown in FIG. 2.

FIG. 5 shows two two-dimensional time diagrams similar to the ones shown in FIG. 2. It shows in more detail the transition into self-refresh mode and shows the use of VB-ID bits 3 and 6, and the use of CRC checks to ensure that if there is an error in the active frame that it is not stored in the RFB and not used for self-refresh. An active frame N 502 and active frame N+1 504 are consecutively sent over the main link to the sink. At some point during the period for active frame N 502 (during the time that frame N 502 is being transmitted), the source determines that the frame will be static and determines to enter self-refresh mode. VB-ID bit 6 and bit 3 are initially both 0 (this is the setting when the system is in normal or "source refresh" mode). When self-refresh mode is enabled by the source (or by the sink) initially, bit 6 is switched to 1 and bit 3 remains 0. This indicates that, beginning with the next active frame, the sink will write the frame into RFB. When the period for active frame N+1 starts, bit 6 is 1 (and bit 3 is still 0). Once the period for active frame N+1 is over (and the frame has been written to the RFB), a CRC check is performed. The CRC check passes assuming that a clean and correct frame was transmitted and written to the remote frame buffer. Once the CRC check passes, bit 6 is switched to 0 and bit 3 is switched to 1. This is the signal or indication to the sink that it should switch to self-refresh mode. The source switches to SST idle pattern. In one embodiment, this continues for at least 8 lines, where bit 6 is 0 and bit 3 is 1. After this time, the main link is turned off.

The displayed video frame on the sink device consecutively shows active frame N and N+1 both over main line. As noted, frame N+1 has been written to the RFB because of the VB-ID bit values changing on the source, as described above. An active frame N+1 506 (which has the same context as frame N+1 504) is read from the RFB. A self-refresh vertical period is shown by arrow 508 and a self-refresh horizontal period is shown by arrow 510. These periods can be different from the received horizontal period 512 and received vertical period 514 (during normal mode), as shown in previous figures, but do not have to be. They can be the same as the normal periods before self-refresh mode is enabled.

Figure 6:
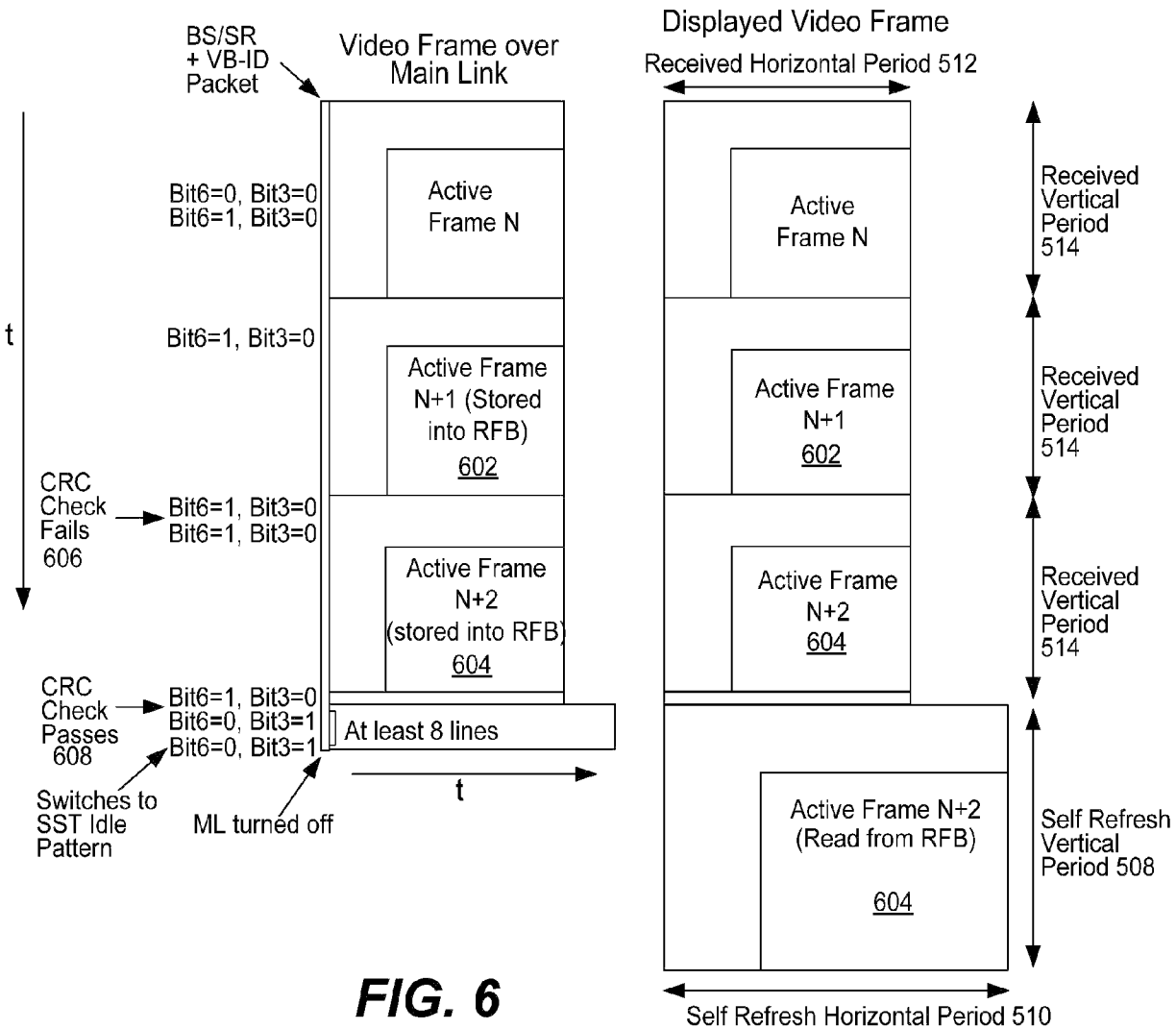
FIG. 6 is a time diagram showing a CRC check failing.

FIG. 6 is a similar time diagram as shown in FIG. 5 except that the CRC check fails indicating that the frame was not written correctly to RFB (or some other error occurred). Consequently, an active frame N+1 602, which may have been used for self-refresh by the sink (when bit 6 is switched to 1), is not used because the CRC check failed at 606. Bit 3 is not switched to 1. This is shown by active frame N+2 604 being displayed on the sink after active frame N+1 602, instead of active frame N+1 602 being read from RFB and displayed again. Bit 6 remains as 1 after the CRC check fails for frame N, subsequently, active frame N+1 602 is also stored in the RFB (the source still wants the system to go into self-refresh mode) and another CRC check is performed. This time it passes shown at 608, bit 3 is switched to 1, and the process described above for FIG. 5 is performed. This time active frame N+2 604, read from the RFB, is used by the sink for self-refresh.

Figure 7:
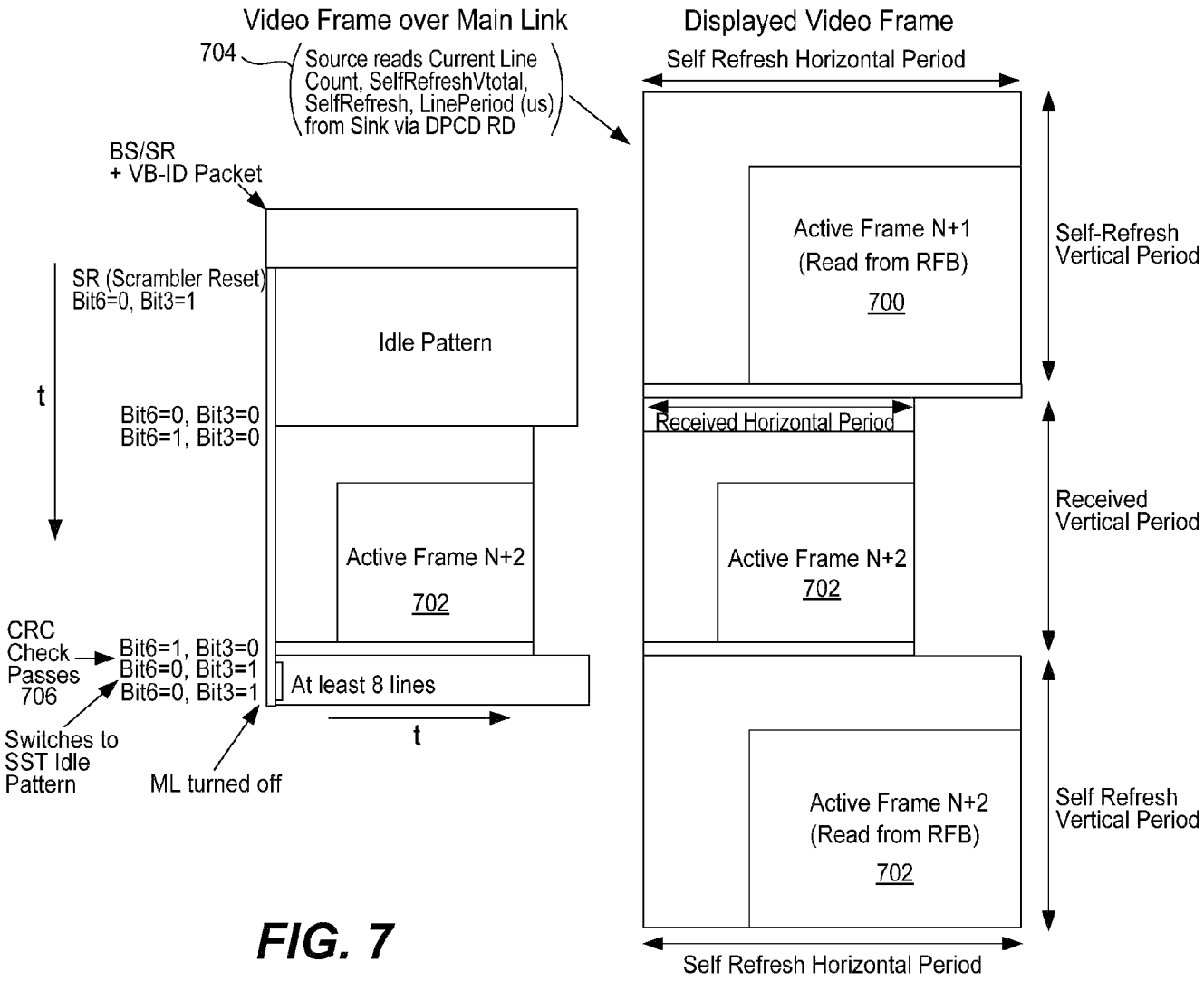
FIG. 7 is a time diagram showing a scenario where the system goes from self-refresh mode to source refresh mode back to self-refresh mode.

FIG. 7 is also a two-dimensional time diagram showing a scenario where the system goes from self-refresh mode (with active frame N+1 700) to source refresh mode (for active frame N+2 702) back to self-refresh where frame N+2 702 is read from RFB. Source refresh mode is enabled (and the main link is turned back on) when the source reads the current line count, total line count, and the line period from the sink at 704. When a CRC check passes at 706, self-refresh mode is enabled again.

Figure 8:
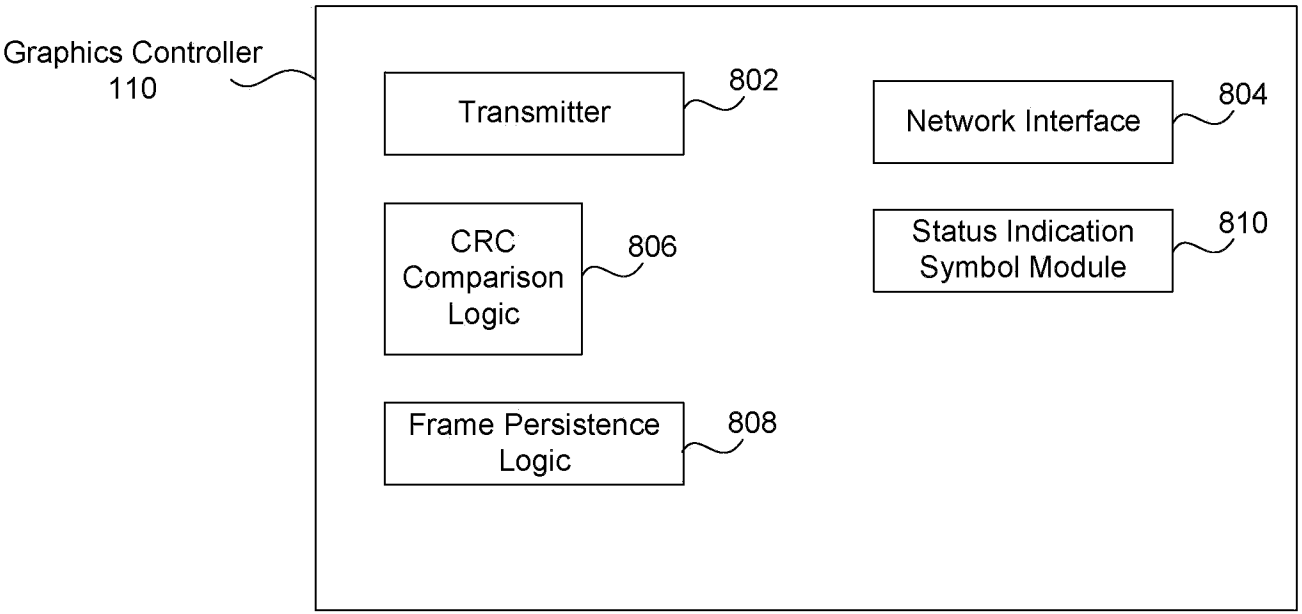
FIG. 8 is block diagram of graphics controller in a source device.

FIG. 8 is block diagram of graphics controller 110 in source 100 in accordance with one embodiment. A transmitter 802 is used to source or transmit video and other data from graphics controller 110. A network interface 804 interfaces with one or more communication channels connected to controller 110, such as main link or display interface 112 and auxiliary or sideband channel 118. It may also have the ability to turn off main link 112 under certain conditions. There are at least three firmware modules or logic components in controller 110 that are relevant to the present invention. They perform the functions described above. One may be referred to a CRC comparison logic or firmware 806 which accepts as input the sink-derived CRC value for the frame stored in the RFB. It compares this value with a source-derived CRC value, which CRC comparison logic or firmware 806 may compute (or it may be computed by other logic in controller 110). The output of CRC firmware 806 is used to determine whether the sink can go into self-refresh mode, as described above. A frame persistence logic module or firmware 808 is used by controller 110 to determine whether the current frame will change or persist using graphics rendering commands and whether such commands are executed. Other methods for determining video frame persistence known in the art may be used. A status indication symbol logic module or firmware 810 changes the bit values of the VB-ID or, more generally, the primary video status indication symbol. For example, it can change the values of bits 6 and 3 as needed to enable video frame self-refresh.

What is claimed is:

1. A method of enabling self-refreshing of video frame data on a sink device, the method comprising:

determining that a video frame will persist;

setting a first bit of a primary video status indication symbol to 1;

calculating a source-derived cyclic redundancy check (CRC) value;

receiving a sink-derived CRC value from the sink device;

determining whether the source-derived CRC value and the sink-derived CRC value are equal;

completing transmission of the video frame to the sink device where the video frame is stored in a sink buffer; and terminating transmission of subsequent video frame data to the sink device, wherein the sink device reads the stored video frame in the sink buffer for display on a panel in the sink device.

2. A method as recited in claim 1 wherein determining that a video frame will persist further comprises:

examining graphics rendering commands; and determining whether said commands have been executed.

3. A method as recited in claim 1 wherein determining whether the source-derived CRC value and the sink-derived CRC value are equal further comprises:

comparing the source-derived CRC value and the sink-derived CRC value in a graphics controller of the source device.

4. A method as recited in claim 1 further comprising:

setting a second bit in the primary video status indication symbol to 1 upon determining the source-derived CRC value and the sink-derived CRC value are equal, wherein the second bit indicates whether a video stream is being transmitted.

5. A method as recited in claim 4 further comprising:

switching to an idle pattern after setting the second bit to 1.

6. A method as recited in claim 4 further comprising:

turning off a main link between the source device and the sink device after the second bit in the primary video status indication symbol is 1 for a predetermined number of lines.

7. A method as recited in claim 1 further comprising:

disabling a self-refresh mode of the sink device based on an active video line total.

8. A method as recited in claim 7 further comprising:

disabling a self-refresh mode of the sink device based on a total line count.

9. A method as recited in claim 8 further comprising:

disabling a self-refresh mode of the sink device based on a line period.

10. A method as recited in claim 9 wherein the line period is a self-refresh video frame line period.

11. A method as recited in claim 9 further comprising:

receiving the active video line total, the total line count, and the line period in a single auxiliary burst read.

12. A method as recited in claim 1 wherein the first bit is set to 0 to disable self-refresh on the sink device.

13. A method as recited in claim 1 further comprising:

adjusting the timing of resuming transmission of video frame data to coincide with a vertical blanking interval of a self-refresh video frame.

14. A method as recited in claim 1 wherein the sink device determines to enter a self-refresh mode if it does not receive video data from the source device for a predetermined amount of time.

15. A source device comprising:

a source frame buffer for storing video frame data;

a network interface for interfacing with a main link and an auxiliary channel; and a graphics controller having a transmitter for sourcing video data over the main link and a cyclic redundancy check (CRC) value comparison logic module, a frame persistence module, and a primary video status indication symbol modification module, wherein the frame persistence module is configured to determine whether a video frame will persist, the symbol modification module is configured to set a value of a primary video status indication symbol based on a determination that a video frame will persist, and the transmitter is configured to terminate sourcing video data based on an output of the CRC value comparison logic module.

16. A source device as recited in claim 15 wherein the graphics controller reads video frame data from the source frame buffer and writes video frame data to the source frame buffer.

17. A source device as recited in claim 15 wherein the CRC value comparison logic module compares a source CRC value and a sink CRC value.

18. A source device as recited in claim 15 wherein the symbol modification module switches one or more values of one or more bits in a primary video status indication symbol, wherein said switches in values depend on video frame properties.

19. A source device as recited in claim 18 wherein the video frame properties include frame persistence and a video frame CRC check.

20. A source device as recited in claim 15 wherein the frame persistence module determines whether a video frame will persist by examining graphics rendering commands.

21. A source device as recited in claim 15 further comprising:

a source CRC calculation module.

22. A graphics controller comprising:

a transmitter;

a network interface for interfacing with one or more data communication channels;

a cyclic redundancy check (CRC) checking module for performing CRC checks;

a video frame persistence module for determining whether a video frame will persist; and a primary video status indication symbol modification module for changing bits in a status indication symbol based on a determination that a video frame will persist, wherein the transmitter is configured to terminate transmission of video frame data based on an output of the CRC checking module.

23. A graphics controller as recited in claim 22 wherein the CRC checking module compares a source CRC value and a sink CRC value.

24. A graphics controller as recited in claim 23 wherein the CRC checking module calculates the source CRC value.

25. A graphics controller as recited in claim 22 wherein the symbol modification module changes bits in a status indication symbol depending on frame persistence and a video frame CRC check.

26. A graphics controller as recited in claim 22 wherein the frame persistence module determines whether a video frame will persist by examining graphics rendering commands.

* * * * *